US005956558A

United States Patent [19]

Hong et al.

[11] Patent Number: 5,956,558

[45] Date of Patent: Sep. 21, 1999

[54] FABRICATION METHOD FOR TUNGSTEN HEAVY ALLOY

[75] Inventors: Moon Hee Hong, Seoul; Woon Hyung Baek, Daejon; Joon Woong Noh, Daejon; Heung Sub Song, Daejon; Seong Lee, Daejon; Eun Pyo Kim, Daejon, all of Rep. of Korea

[73] Assignee: Agency for Defense Development, Daejon, Rep. of Korea

[21] Appl. No.: 08/841,714

[22] Filed: Apr. 30, 1997

[30] Foreign Application Priority Data

Apr. 30, 1996 [KR] Rep. of Korea ..... 96-13836

[51] Int. Cl.[6] ..... B22F 3/26

[52] U.S. Cl. ..... 419/27; 419/38; 419/54; 419/57

[58] Field of Search ..... 419/27, 38, 54, 419/57

[56] References Cited

U.S. PATENT DOCUMENTS

| | | | |
|---|---|---|---|
| H1146 | 3/1993 | Kapoor | 148/673 |
| 2,200,088 | 5/1940 | Kelly | 200/166 |
| 2,456,779 | 12/1948 | Goetzel | 75/22 |
| 2,581,252 | 1/1952 | Guetzel et al. | 75/22 |
| 2,612,443 | 9/1952 | Goetzel et al. | 75/22 |
| 2,694,007 | 11/1954 | Goetzel et al. | 75/204 |
| 2,714,556 | 8/1955 | Goetzel | 75/203 |
| 2,753,859 | 7/1956 | Bartlett | 123/188 |
| 2,843,501 | 7/1958 | Ellis et al. | 117/50 |
| 3,285,714 | 11/1966 | Davies et al. | 29/182.1 |
| 3,411,902 | 11/1968 | Krock et al. | 75/208 |
| 3,721,550 | 3/1973 | Schreiner et al. | 75/208 R |
| 3,888,636 | 6/1975 | Sczerzenie et al. | 29/182 |
| 3,929,424 | 12/1975 | Krock et al. | 29/182.1 |
| 3,979,234 | 9/1976 | Northcutt, Jr. et al. | 148/126 |
| 4,327,156 | 4/1982 | Dillon et al. | 428/568 |
| 4,431,449 | 2/1984 | Dillon et al. | 75/246 |
| 4,491,558 | 1/1985 | Gardner | 419/23 |
| 4,554,218 | 11/1985 | Gardner et al. | 428/567 |
| 4,710,223 | 12/1987 | Matejczyk | 75/248 |
| 4,784,690 | 11/1988 | Mullendore | 75/248 |
| 4,990,195 | 2/1991 | Spencer et al. | 148/11.5 F |
| 5,069,869 | 12/1991 | Nicolas et al. | 419/28 |
| 5,126,102 | 6/1992 | Takahashi et al. | 419/2 |
| 5,462,576 | 10/1995 | Stuitje et al. | 75/248 |
| 5,603,073 | 2/1997 | Bose | 419/57 |

*Primary Examiner*—Daniel J. Jenkins
*Attorney, Agent, or Firm*—Nikaido, Marmelstein, Murray & Oram LLP

[57] ABSTRACT

A fabrication method for a tungsten heavy alloy includes first fabricating a green compact or a sintered body composed of tungsten and other elements except manganese, then putting manganese thereon, and sintering the tungsten heavy alloy with manganese manganese, whereby the formation of pores, which occurs because manganese is oxidized by the deoxidation of oxides existing on the surface of powders of tungsten, nickel and iron is prevented, and a tungsten heavy alloy having a 100% non-theoretical density of 100% is obtained.

16 Claims, 6 Drawing Sheets

FABRICATION METHOD FOR TUNGSTEN HEAVY ALLOY

BACKGROUND OF THE INVENTION

1. Field of the Invention

The present invention relates to a tungsten heavy alloy, and in particular, to a fabrication method for a poreless tungsten heavy alloy containing manganese.

2. Description of the Conventional Art

Conventionally, a tungsten heavy alloy is composed of more than 90 weight % tungsten, nickel(Ni), iron(Fe), cobalt(Co) and manganese.

When manganese is added to a W—Ni—Fe type tungsten heavy alloy or a W—Ni—Co tungsten heavy alloy which is chiefly used as a material for a penetrant of a kinetic energy penetrator, the manganese micronizes tungsten particles, and promotes an adiabatic shear band.(A. Bose, H. Couque, J. Lankford, Jr., "Influence of Microstructure on Shear Localization in Tungsten Heavy alloys," MPIF Princeton, N.J., 1992, pp 291–298.) By micronizing tungsten particles and promoting an adiabatic shear band, the mechanical properties and the energy-concentrating degree of a tungsten heavy alloy are increased which consequently contributes to an improvement in the penetrating force.

Therefore, to improve the penetrating force of a kinetic energy penetrator, a W—Ni—Fe—Mn type heavy alloy and a W—Ni—Co—Mn heavy alloy have been developed recently by adding a small amount of manganese to a W—Ni—Fe type heavy alloy and a W—N—Co heavy alloy.

The W—Ni—Fe—Mn type heavy alloy and the W—Ni—Co—Mn heavy alloy are fabricated by liquid phase sintering as follows; First, a proper composition of powders of tungsten, nickel, iron, cobalt and manganese are mixed and compacted, and then a liquid phase sintering is performed under a hydrogen atmosphere, as shown in FIG. 1.

FIGS. 2A and 2B are photographs of fine grains of a W—Ni—Fe—Mn tungsten heavy alloy according to the conventional art observed through an optical miscroscope. As shown in FIG. 2A, when 0.1% manganese is contained, round tungsten particles are uniformly distributed in the matrix phase.

However, as shown in FIG. 2B, when more than 0.5% manganese is contained, black pores are disadvantageously formed.

The formation of such a black residual limits the content of manganese, and lowers the mechanical strength of the heavy alloy significantly, and consequently limits the use of the tungsten heavy alloy as a material for a penetrant of a kinetic energy penetrator.

Therefore, to use a tungsten heavy alloy containing manganese for a kinetic energy penetrator, the formation of residual pores should be controlled and the content of manganese should be increased.

SUMMARY OF THE INVENTION

Accordingly, it is an object of the present invention to provide a fabrication method for a tungsten heavy alloy which is poreless and contains more than 0.5% manganese.

To achieve the above object, there is provided a process for fabricating a powdered compact composed of W—Ni—Fe or W—N—Co and a process for sintering tungsten heavy alloy containing manganese whereby manganese is put on the top surface of the compact and absorbed into the compact.

And, there is provided another process for fabricating a sintered body composed of W—Ni—Fe or W—N—Co and tungsten heavy alloy containing manganese whereby manganese is put on the top surface of the sintered body and diffuses into the sintered body.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A and 2B are photographs of the fine grain structure of a tungsten heavy alloy according to the conventional art observed through an optical microscope, wherein FIG. 2A is of a 93W-5.5Ni-1.4Fe-0.1Mn type heavy alloy, and FIG. 2B is of a 93W-3.6Ni-0.9Fe-2.5Mn type heavy alloy;

FIGS. 6A and 6B are photographs of the fine grain structure of a tungsten heavy alloy according to the present invention, wherein FIG. 6A shows the case where manganese is absorbed into a green compact material, and FIG. 6B shows the case where manganese diffused into a sintered material.

DETAILED DESCRIPTION OF THE PREFERRED EMBODIMENTS

Referring to the accompanying drawings, the fabrication method for a tungsten heavy alloy according to the present invention will now be described in detail.

Figure 3:
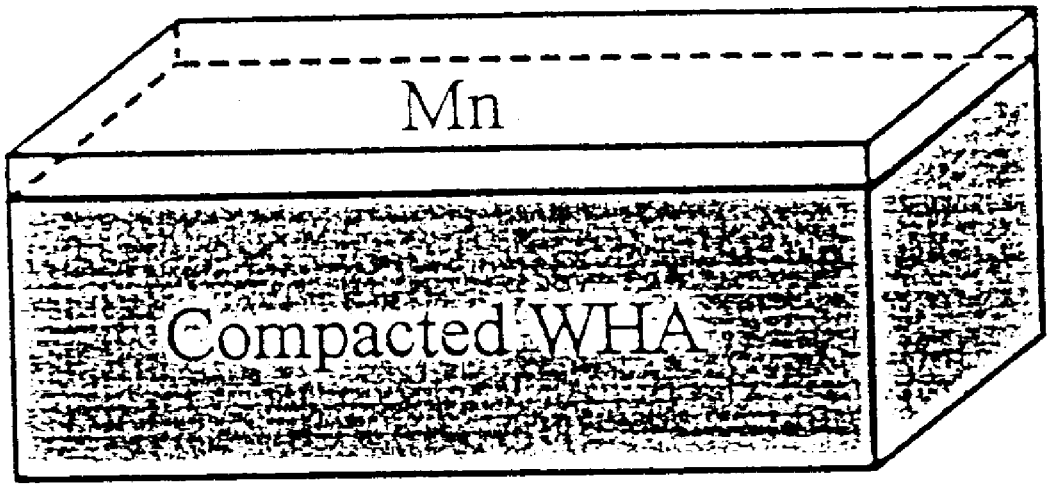
FIG. 3 is a state diagram showing manganese put on the green compact according to the present invention.

FIG. 3 is a state diagram showing manganese put on a green compacted WHA according to the present invention. As shown in this drawing, manganese is put on a green compact of a tungsten heavy alloy in which more than 90 weight % tungsten powder is mixed with more than one kind selected from the powders of nickel, iron, cobalt powder, and is sintered at a temperature of 1350° C.~1500° C. under a hydrogen atmosphere. Here, the manganese having a lower melting point, is melted first and absorbed into the green compact by capillary action, which prevents the formation of pores due to the oxidation.

Another method is similar to the above-described method, with the only difference being that manganese is put on a sintered body, not on a green compact. Here, the earlier fabrication of the sintered body is carried out in accordance with the method shown in FIG. 1. In this case, the deoxidation and sintering of the elements composing the heavy alloy except manganese is performed during the earlier sintering of the sintered body, and consequently the later-added manganese has no opportunity to be oxidized, and the formation of pores can be prevented by diffusion of the manganese into the previously sintered body.

Figure 4:
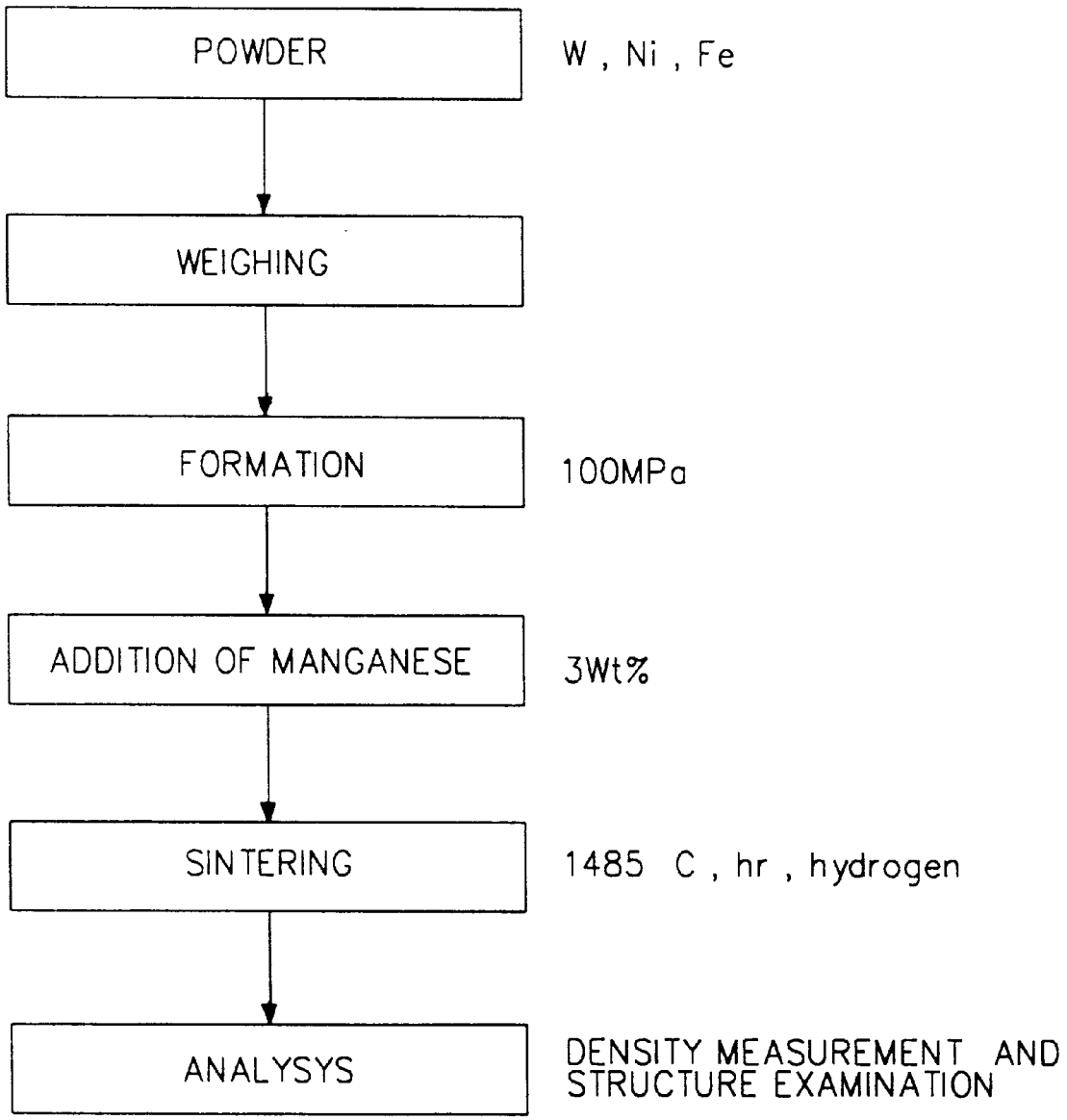
FIG. 4 is a flow chart showing the fabrication step for a tungsten heavy alloy according to the present invention.
Figure 5:
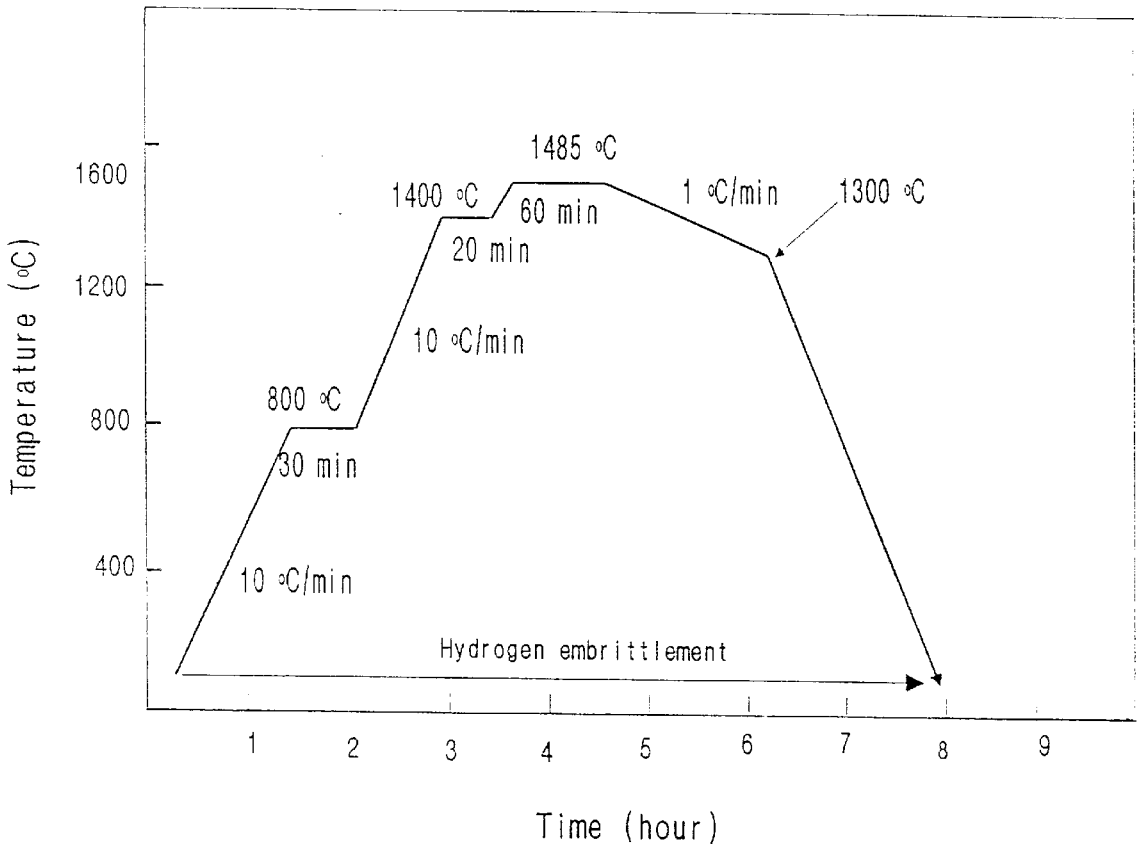
FIG. 5 is a process graph showing the sintering process for tungsten heavy alloy containing manganese according to the present invention.

FIG. 4 is a flow chart showing the fabrication steps for a tungsten heavy alloy according to the present invention. As shown in this drawing, powders of more than 90 weight % tungsten, nickel and iron are mixed at a proper composition rate and compacted. On the top of the thusly fabricated compact, another compact is fabricated to have the 3 weight % manganese, and the thusly fabricated manganese compact is put on the W—Ni—Fe compact, as shown in FIG. 4, and then the sintering process is carried out, as shown in FIG. 5.

The above described two fabrication methods of a tungsten heavy alloy will now be described in more detail through the following examples.

First, the sintering method will be described in which powders of nickel, iron or cobalt and tungsten are mixed to form the compact and manganese is put on the thusly fabricated compact and sintered.

By weight %, a powder composition of 93W-4.8Ni-1.2Fe was measured and mixed, and a compact was fabricated in a floating die of 10 mm×10 mm×750 mm. Then, 1 weight % pure manganese powder was compacted, and put on the top surface of the W—Ni—Fe compact, as shown in FIG. 4, and a first test piece is fabricated according to the sintering process as shown in FIG. 5. A feature of the above-described process is that the formation of pores can be prevented by separating the manganese powder, the affinity of which to oxygen is relatively greater than the powders of tungsten, nickel and iron, and the sintered manganese.

By increasing the content of manganese powder to 3 and 5 weight %, respectively, second and third test pieces were fabricated by the same fabrication method as used for the first test piece. Corresponding test pieces were fabricated according to the conventional art process of FIG. 1.

Table 1 shows the measured density, the theoretical density and relative theoretical density of the above test pieces obtained by the manganese-added method according to the present invention.

Here, the measured density was obtained by using the Archimedean method, and an average value was calculated from the results of more than 5 experiments under each condition. The theoretical density was calculated from the theoretical density of the composing elements of the heavy alloy in consideration of the composition of the heavy alloy, assuming that no pores exist.

As shown in Table 1, test pieces 1 and 2 obtained by the sintering method of the present invention had almost 100% theoretical density although the test pieces had a greater content of manganese than test pieces 4,5,6 obtained by the conventional art process. The reason is that the formation of pores due to the manganese not deoxidized during sintering is prevented by separating the manganese which is oxidized to a relatively greater extent than the powders of tungsten, nickel and iron.

Figure 6A:
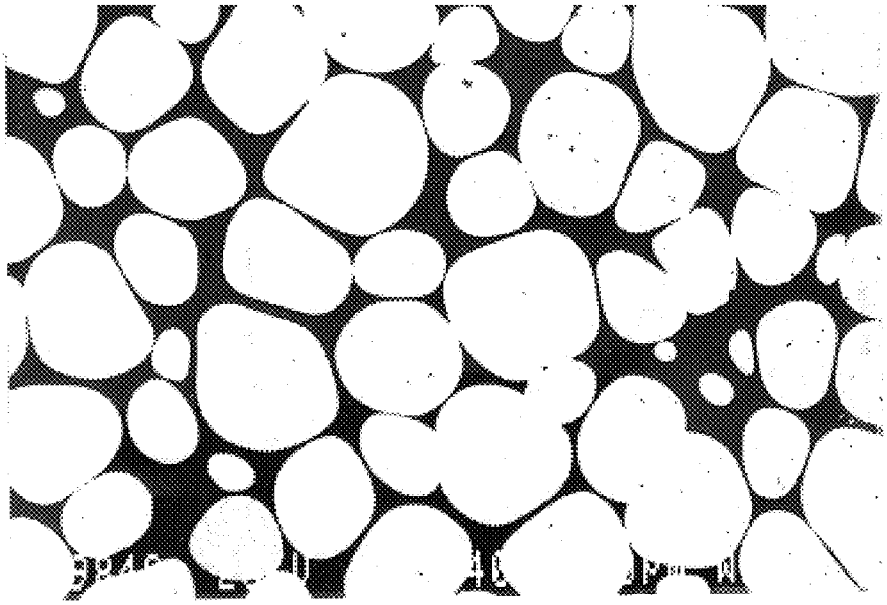

A photograph of the microstructure of the test pieces sintered by the above-described process shows the formation of few pores in the W—Ni—Fe—Mn heavy alloy more clearly. FIG. 6A shows that the microstructure of test piece 3 fabricated in accordance with the method of the present invention has few pores, although it has a high content of Mn.

TABLE 1

| method | ntp | mn aa | md | td | ntd |
|---|---|---|---|---|---|
| present invention | 1 | 1.0 | 17.53 | 17.53 | 100 |
| | 2 | 3.0 | 17.07 | 17.07 | 100 |

TABLE 1-continued

| method | ntp | mn aa | md | td | ntd |
|---|---|---|---|---|---|
| | 3 | 5.0 | 16.62 | 16.65 | 99.8 |
| conventional art | 4 | 0.5 | 17.00 | 17.47 | 98.5 |
| | 5 | 1.0 | 17.25 | 17.53 | 97.4 |
| | 6 | 2.5 | 16.80 | 17.61 | 95 |

<note>
ntp: number of test pieces mn aa: mn added amount (weight %) md: measured density (g/cm$^3$) td: theoretical density (g/cm$^3$) ntd: relative theoretical density (%)

Next, another sintering method will be described in detail wherein a tungsten powder and a powder of one of nickel, iron and cobalt are mixed to form a sintered body and manganese is put on top thereof.

Figure 1:
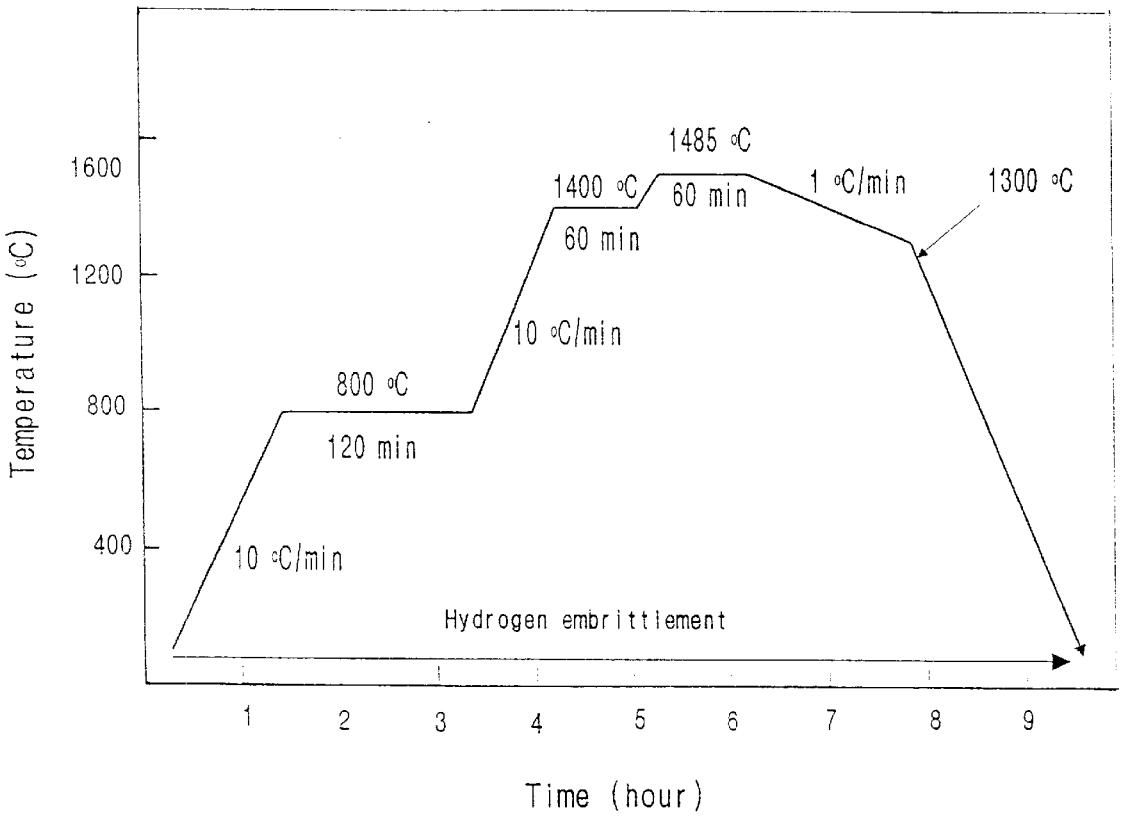
FIG. 1 CONVENTIONAL ART
FIG. 1 is a process graph showing the sintering process for a conventional tungsten heavy alloy.
Figure 2A:
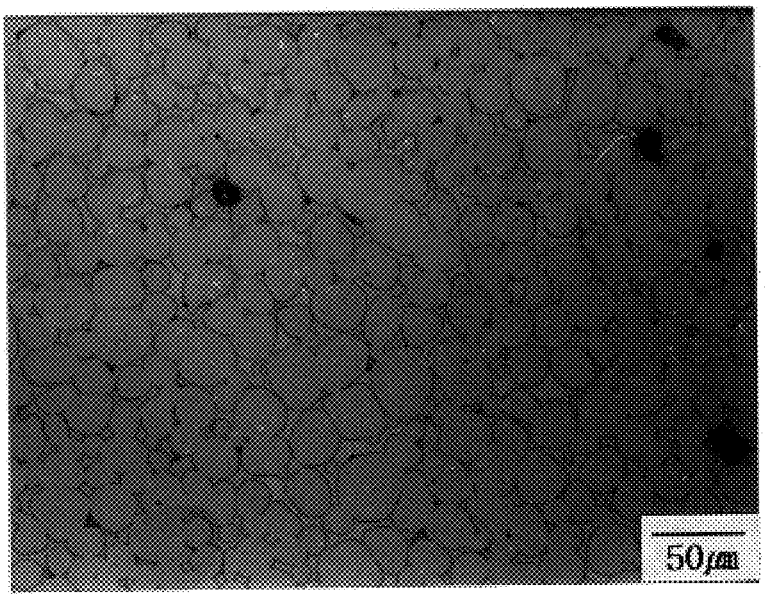
FIG. 2A CONVENTIONAL ART
Figure 2B:
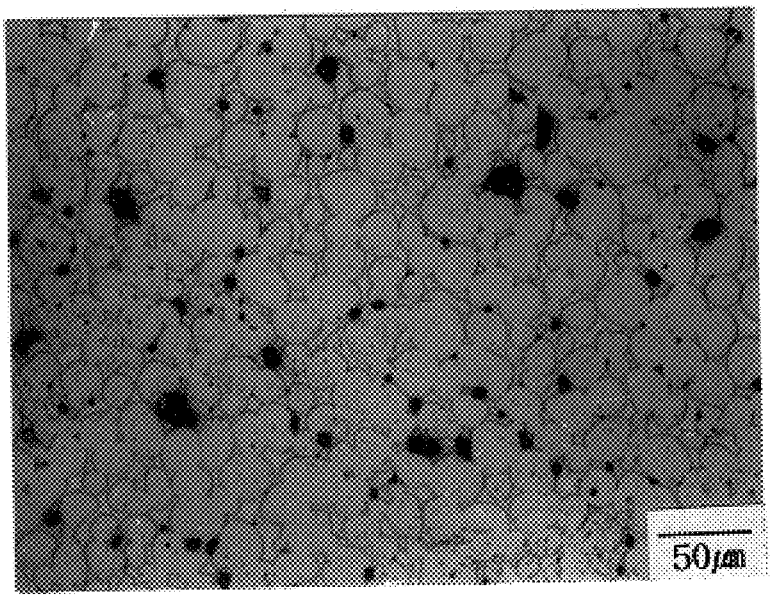
FIG. 2B CONVENTIONAL ART

Test pieces were fabricated by the same method as for the test pieces 1 and 2 in Table 1, but instead of the W—Ni—Fe compact, the compact was sintered by the known method as shown in FIG. 1. Test pieces were fabricated using the thusly fabricated sintered body instead of a compact and the density and microstructure of the test pieces were examined.

Table 2 shows the results obtained from the above-described manganese-added method.

Figure 6B:
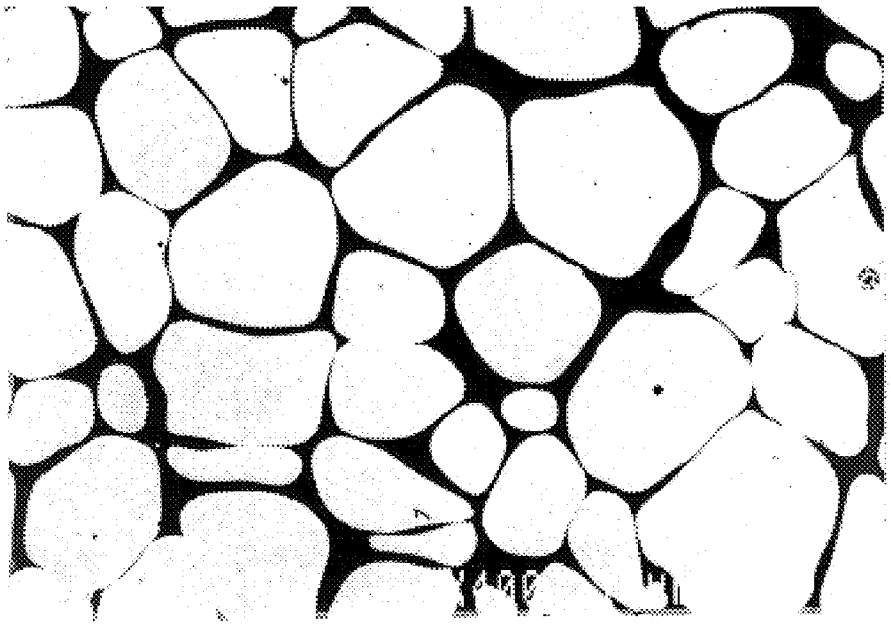

As shown in Table 2, although manganese was put on the sintering body and added thereon, a W—Ni—Fe—Mn heavy alloy having a relative theoretical density of 100% can be fabricated. FIG. 6B is a photograph of the fine grain structure of test piece 8 observed through an optical microscope among the test pieces of Table 2 fabricated according to the above-described method, and few pores are found therein.

TABLE 2

| ntp | mn aa | md | td | ntd |
|---|---|---|---|---|
| 7 | 1.0 | 17.71 | 17.71 | 100 |
| 8 | 3.0 | 17.58 | 17.58 | 100 |

<note>
ntp: number of test pieces mn aa: mn added amount (weight %) md: measured density (g/cm$^3$) td: theoretical density (g/cm$^3$) ntd: relative theoretical density (%)

As described above, according to the fabrication method of the present invention, heavy alloys which have few pores and a theoretical density of 100% can be fabricated, and this fabrication method can be adapted to the manganese-added method for tungsten heavy alloys having different composition.

That is, W—Ni—Cu, W—N—Co and W—Ni—Fe—Co type heavy alloys are described for example, only and accordingly, the method as described is not limitative of the fabrication of the W—Ni—Fe—Mn type heavy alloys. Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed:

1. A fabrication method for a tungsten heavy alloy, which comprises more than 90 weight % tungsten, comprising fabricating a heavy alloy compact with a mixture of the more than 90 weight % tungsten and more than one element selected from nickel, iron and cobalt; and putting manganese on a top surface of the compact and sintering the resulting product until the manganese is absorbed into the compact.

2. The fabrication method of claim 1, wherein the sintered compact comprises manganese in an amount which ranges from 0.5 weight % to 5 weight %.

3. The fabrication method of claim 1, wherein the temperature of the sintering is 1350° C.~1500° C., and the time of the sintering is one to eighty minutes.

4. The fabrication method of claim 1, wherein said sintering is carried out under a hydrogen atmosphere.

5. A fabrication method for a tungsten heavy alloy containing manganese, which alloy comprises more than 90 weight % tungsten, comprising fabricating a sintered body of a heavy alloy by sintering a mixture of the more than 90 weight % tungsten and more than one element selected from nickel, iron and cobalt; and putting manganese on a top surface of the sintered body and re-sintering until the manganese diffuses into the sintered body.

6. The fabrication method of claim 5, wherein said tungsten heavy alloy containing manganese comprises manganese in an amount which ranges from 0.5 weight % to 5 weight %.

7. The fabrication method of claim 5, wherein the temperature of the is 1350° C.~1500° C., and the time of the re-sintering is one to eighty minutes.

8. The fabrication method of claim 5, wherein said re-sintering is carried out under a hydrogen atmosphere.

9. A fabrication method for a tungsten heavy alloy, which comprises more than 90 weight % tungsten, the method consisting essentially of the following steps:

fabricating a heavy alloy compact by mixing components consisting essentially of more than 90 weight % tungsten and more than one element selected from nickel, iron and cobalt; and putting manganese on a top surface of the compact and sintering the resulting product until the manganese is absorbed into the compact.

10. The fabrication method of claim 9, wherein the sintered compact comprises manganese in an amount which ranges from 0.5 weight % to 5 weight %.

11. The fabrication method of claim 9, wherein the temperature of the sintering is 1350° C.~1500° C., and the time of the sintering is one to eighty minutes.

12. The fabrication method of claim 9, wherein said sintering is carried out under a hydrogen atmosphere.

13. A fabrication method for a tungsten heavy alloy containing manganese, which alloy comprises more than 90 weight % tungsten, the method consisting essentially of the following steps:

fabricating a sintered body of a heavy alloy by sintering a mixture consisting essentially of more than 90 weight % tungsten and more than one element selected from nickel, iron and cobalt; and putting manganese on a top surface of the sintered body and re-sintering until the manganese diffuses into the sintered body.

14. The fabrication method of claim 13, wherein said tungsten heavy alloy containing manganese comprises manganese in an amount which ranges from 0.5 weight % to 5 weight %.

15. The fabrication method of claim 13, wherein the temperature of the re-sintering is 1350° C.~1500° C., and the time of the re-sintering is one to eighty minutes.

16. The fabrication method of claim 13, wherein said re-sintering is carried out under a hydrogen atmosphere.

* * * * *